United States Patent [19]

Phelps

[11] Patent Number: 4,691,852

[45] Date of Patent: Sep. 8, 1987

[54] GUN SLING

[76] Inventor: Warren C. Phelps, Rte. 2, Sidney, Nebr. 69162

[21] Appl. No.: 544,262

[22] Filed: Oct. 21, 1983

[51] Int. Cl.[4] ..... F41C 33/00

[52] U.S. Cl. ..... 224/150; 224/913

[58] Field of Search ..... 224/913, 257, 149, 150

[56] References Cited

U.S. PATENT DOCUMENTS

| | | | |
|---|---|---|---|
| 1,332,088 | 2/1920 | Wagner | 224/150 |
| 2,296,733 | 9/1942 | Paolino | 224/913 X |
| 2,350,484 | 6/1944 | Williams | 224/913 X |
| 2,576,559 | 11/1951 | Bennek | 224/149 |
| 2,884,172 | 4/1959 | Kubo | 224/913 X |
| 2,915,233 | 1/1959 | Moomaw . | |
| 3,081,923 | 3/1963 | Bagby . | |
| 3,221,958 | 12/1965 | Straight | 224/149 |
| 3,334,794 | 8/1967 | Saari et al. | 224/150 |
| 3,430,828 | 3/1969 | Gregson . | |
| 3,495,770 | 2/1970 | Seltmann, Jr. et al. . | |
| 3,606,109 | 9/1971 | Brokus . | |
| 4,098,441 | 7/1978 | Campbell | 224/150 |

*Primary Examiner*—Stephen Marcus
*Assistant Examiner*—Robert M. Petrik
*Attorney, Agent, or Firm*—Leydig, Voit & Mayer

[57] ABSTRACT

A sling adapter is provided for use in combination with a flexible sling to carry a firearm having a stock, the sling adapter comprising an elongated, generally planar member having first and second ends and being commensurate in length with the longitudinal dimension of the butt end of the stock of the firearm; means at the first end of the elongated member for rotatably attaching the first end of the member to a flexible sling; means at the second end of the elongated member for releasably and rotatably attaching the second end of the member to the underside of the fixed stock; wherein the sling adapter is so constructed and arranged with respect to the butt end of the stock that the firearm can be carried in a substantially horizontal stable position while suspended from the shoulder of the bearer of the firearm in a position for firing.

7 Claims, 7 Drawing Figures

GUN SLING

TECHNICAL FIELD

The present invention relates to a multiple position weapon sling.

BACKGROUND ART

Slings have been employed with hand-carried firearms by both hunters and military personnel for many years. The purpose of such devices is to relieve the bearer from the burden of carrying the firearm (normally a rifle) with his arms except during those periods of time in which it is anticipated that the firearm will be used or is actually being used. A soldier may frequently be required to carry other equipment or ammunition with his hands for some distance. The conventional rifle sling, although permitting a rifle to be carried by a soldier while freeing his hands to perform other tasks, does not permit access to the weapon as readily as is normally desired in a combat situation. Thus, the conventional sling, a flexible strap connected at one end to a terminal at the forward or muzzle end of the firearm and at the other end to the gun stock (normally on the underside of the rear portion of the stock) permits the firearm to be either suspended from one shoulder of the bearer or to be carried diagonally across the back of the firearm bearer. In the event that the weapon must be aimed and discharged quickly, both of the above-described carrying positions require time to reorient the weapon, time which may not be available. The manipulations are made additionally cumbersome when the bearer is wearing thick or heavy clothing or is restricted in his movements by his surroundings.

The subject invention is directed then to a sling adapter and sling assembly which serves in large measure to alleviate the problems described above.

DISCLOSURE OF THE INVENTION

The present invention is directed to a sling adapter which may be used with a conventional, flexible sling strap or web and a conventional firearm, such as a rifle, and more particularly a modern military rifle, such as the M-16. The sling adapter of this invention, in combination with a flexible sling (the combination referred to herein as a "sling assembly"), permits the firearm to be carried in a number of different positions, which positions include those in which the bearer's arms are relieved from holding the firearm while it is suspended from the bearer's body. The present invention permits the gun to be carried in various stable positions and to be quickly repositioned for accurately aiming and discharging the weapon.

The instant invention comprises a sling adapter comprising an elongated, generally planar member, first and second attachment means at opposite ends of the generally planar member for (1) rotatably attaching one end of the planar member to a terminal on the underside of the stock of the firearm and (2) rotatably connecting the other end to a flexible sling strap. Preferably, the first and second means comprise first and second rotatable swivels rings or the like and a clip is attached to one of the swivel rings for securing one end of the sling adapter to the underside of the gun stock. The elongated, generally planar member is generally commensurate in length with the height of the gun butt and so constructed and arranged with respect to the gun butt that the firearm can be carried in a substantially stable horizontal position while suspended by a flexible sling from the shoulder of the gun bearer. The sling adapter is secured at one end (preferably by the clip referred to above) to the rear, lower portion or underside of the stock and at the other end (via the rotatable swivel or loop) to a flexible sling strap with the opposite end of the sling strap being secured to a sling securing terminal at the forward or muzzle end of the weapon.

BEST MODES FOR CARRYING OUT THE INVENTION

Figure 1:
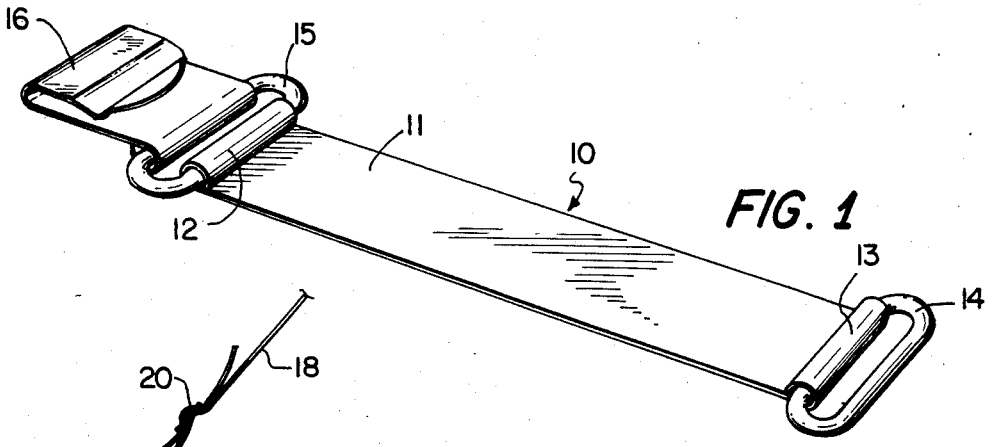
FIG. 1 is a perspective view of the pivoting sling adapter oF the present invention.
Figure 2:
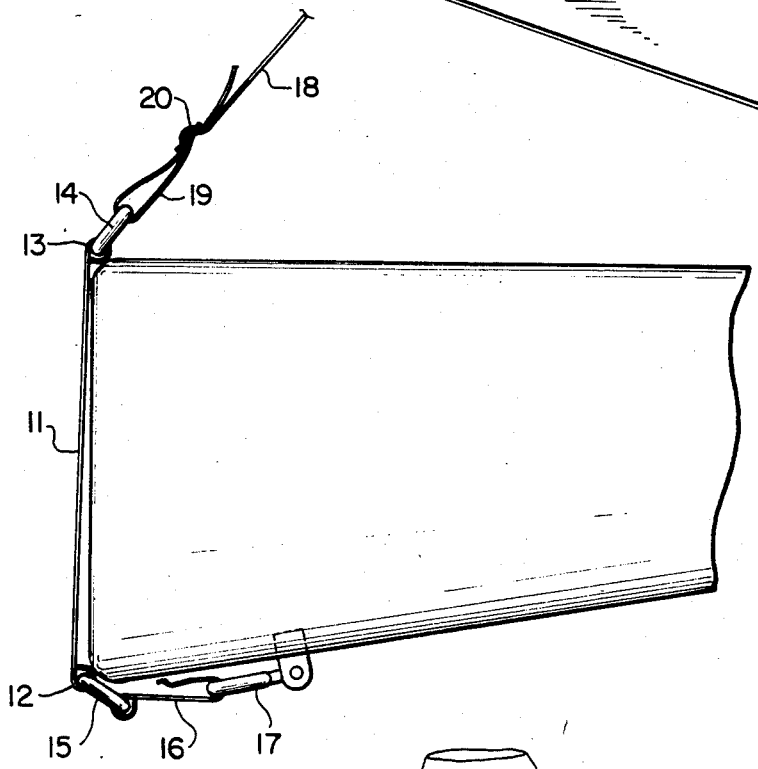
FIG. 2 is an elevation view of the sling adapter of the present invention in operative relationship with the butt end of the stock of a rifle.
Figure 3:
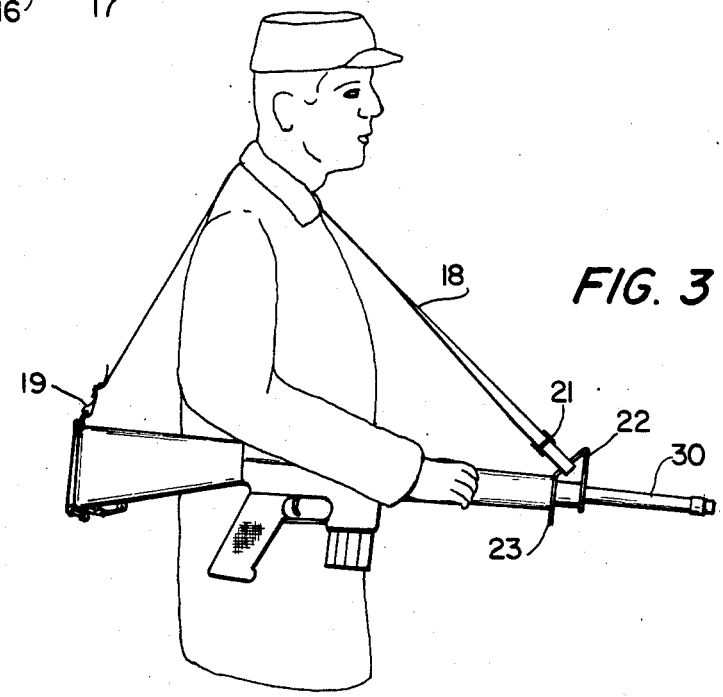
FIG. 3 depicts a man carrying a rifle in the patrol position using the sling assembly of this invention.

Referring to FIGS. 1 and 2, a preferred embodiment of the pivoting sling adapter 10 of this invention is illustrated. It comprises a member 11 in the form of an elongated, generally planar strip of material which provides strength and rigidity, such as, preferably, steel, a rigid fracture resistant plastic or a nylon mesh having a rigid reinforcing plastic insert. The member 11 is formed as an elongated, generally flat or planar member, the ends of which have been rolled to form generally cylindrical or tubular sleeves 12 and 13 which secure respective swivels, rings or loops 15 and 14 to the opposite ends of the planar member 11. The loops 14 and 15 are free to rotate or swivel while constrained within their respective sleeves. As illustrated in FIGS. 2 and 3, the planar member 11 is generally commensurate in length with the height of the butt of the rifle stock and is, preferably, (1) of about the same width as the width of the butt, or (2) somewhat narrower. A swivel clip 16 is rotatably secured to the loop 15 and, as is illustrated in FIG. 2, is secured to the lower, rearward portion of the rifle stock via sling terminal or swivel 17.

As shown in FIG. 2, in use the sling attachment swivel or loop 14 at one end of member 11 is attached to a flexible sling strap or web 18 by passing a portion of the flexible strap through the swivel 14 to form a loop 19 and securing the sling by a length and/or tension adjustment means such as a buckle 20.

The opposite end of the planar member 11 is rotatably and detachably secured to the sling terminal 17 which, in the embodiment illustrated in FIG. 2, is mounted on the rear underside portion of the gun stock. The rotatable, detachable attachment means is preferably formed from two elements, such as in the embodiment shown in FIGS. 1 and 2 wherein (1) an oblong ring or swivel 15 is rotatably secured to member 11 by virtue of one of its sides being rotatably secured within the tubular sleeve 12 and the opposite side is rotatably secured to (2) the clip 16. It should also be noted that while the pivoting sling adapter 10 can be detached from the sling strap 18 by unfastening the adjustable securing means or buckle 20, this disassembly process is much more time consuming than the detachment or release contemplated and achieved by the clip 16.

As illustrated in FIGS. 1 and 2, the rotatable, detachable attachment means used for securing the sling adapter 10 to the rifle stock may comprise a loop or ring 15 which is similar to or the same as the sling attachment loop 14. The loop is rotatably secured to the extension strap 11 by means of a cylinder or sleeve 12 formed at the end of the extension strap or planar member 11 through which the loop 15 passes. The internal diameters of the sleeves 12 and 13, respectively, are sufficiently larger than the sides of the oblong loops 15 and 14, respectively, contained therein to permit free rotation of the rings or loops within the sleeves. A clip 16 is rotatably attached to the opposite side of the loop 15 to form the preferred two-element detachable attachment means. The clip is preferably formed in cross-section as a generally U-shaped or arcuately shaped member, one end of which is rotatably secured to loop 15. The clip 16, as viewed from the side in FIG. 2, has the general appearance of a fishhook. To permit the clip 16 to be easily attached to a member, such as the sling terminal 17, the free end of the clip preferably is formed with a slight lip or outward flare, as illustrated in FIG. 2. To permit generally facile attachment and detachment of the clip, the clip should be formed from a material which provides a slight flexibility at the open end of the clip. Materials, such as plastic or, preferably, steel, having a slight temper or spring may be used. For the other elements of the pivoting sling adapter of the present invention, a strong, rigid plastic or steel may be employed.

Figure 6:
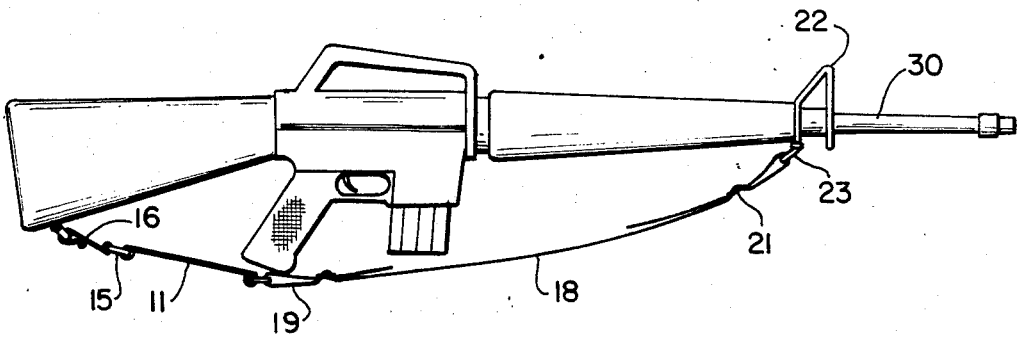
FIG. 6 is an elevation view of the sling assembly of the present invention assembled on a military rifle, the forward end of the sling attached to the front swivel of the rifle.

As indicated above and as illustrated in FIG. 2, the web or sling strap 18 is rotatably attached to the pivoting weapon sling by means of loop 19 and ring 14. The other end of the strap 18 is attached to the weapon near the muzzle end 30, as illustrated in FIG. 3. The strap may be secured to the weapon near the muzzle end of the rifle with a strap securing means, such as a conventional swivel or sling terminal 23 mounted on the underside of the weapon, as illustrated in FIG. 6. Alternatively, some military rifles, such as the M-16, are provided with a front sight 22 having a design which allows the strap to be secured to the top side of the rifle close to the muzzle end.

Figure 7:
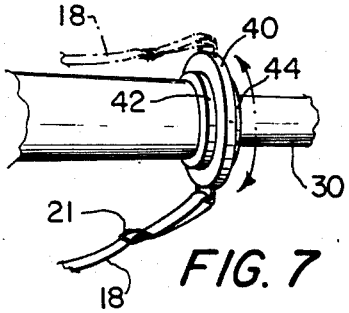
FIG. 7 is a perspective view of a forward portion of a rifle showing a rotatable sling securing means.

The strap may also be secured at the forward end of the weapon to a sling terminal which is rotatable or pivotable between the underside and upper side of the weapon near the muzzle or barrel end. Such an embodiment is illustrated in FIG. 7, which shows a sling terminal 40 rotatable about the longitudinal axis of the barrel. The sling terminal 40, as illustrated, is in the form of a washer slipped over the barrel and rotatably secured at a forward position on the firearm. The washer 40 also includes an aperture, such as a slot or perforated top through which the flexible strap can be passed, as illustrated in FIG. 7. In the embodiment shown in FIG. 7, the sling terminal 40 is rotatably secured to the gun between two fixed flanges 42 and 44 having outer dimensions larger than the diameter of the central hole in the washer 40 and the flanges are spaced apart sufficiently to allow rotation of the washer 40.

The sling strap 18 is normally secured to the front sight 22 or forward sling terminal 40 by means of either a clip secured to the end of the strap or the strap is passed through the sight 22 or sling terminal 40 and secured to itself by means of an adjustable slide or buckle 21.

In use, the pivoting weapon sling permits a weapon, such as a rifle, to be carried comfortably in a number of different stable positions and permits the weapon to be brought to an operative or firing position without the delay normally incurred with conventional slings. Thus, the weapon bearer may carry a rifle in the position illustrated in FIG. 3, known to military men as the "patrol position". In this position, the weapon is suspended by the strap 18, which is attached to the weapon at the forward or muzzle end and to the sling adapter of the present invention at the other end, while being draped across one of the shoulders of the bearer. FIG. 3 shows the weapon being suspended from the strap which is draped diagonally across the body, i.e., over the shoulder opposite to that side of the body on which the weapon is being carried. This position is relatively secure since the weight of the weapon tends to pull the strap toward the neck of the bearer and there is relatively little chance of the strap slipping off the bearer's shoulder. However, the strap also could be draped over the shoulder which is on the same side the weapon is being carried. In the patrol position, the strap is positioned on the bearer's shoulder approximately midway between its ends and the weapon assumes a generally horizontal position. When carried in this manner, the elongated planar member 11 is in an upright, generally vertical position. As indicated in FIGS. 2 and 3, in this position, the rotatable means, such as that indicated by element 14, preferably rests at or slightly above the top surface of the butt end of the stock and the tubular sleeve 13 is in contact with the butt at the upper end. In the embodiment illustrated in FIG. 2, the rigidity of the planar member 11 and the contact of the planar member 11 and the sleeves 12 and 13 with the butt end of the stock stabilize the weapon against twisting or rotating about the longitudinal axis of the weapon. It should be appreciated that various modifications can be made in the relative positions and shapes of the first and second attachment means at opposite ends of the planar member to assist in stabilizing the weapon against twisting or rotation. For example, the planar member 11 could be made slightly shorter, the roll of the sleeves 13 and 12 could be reversed and the loops 14 and 15 made larger so that the loops fit over the upper and lower corners of the butt stock, respectively, at the points where the sleeves 13 and 12 are shown contacting the butt stock in FIG. 2.

Should the weapon bearer prefer to carry the weapon in what is known as the "patrol rest position" in which the muzzle end of the weapon is below the butt end of the stock, the bearer need only reposition the sling strap 10 such that it rests on the shoulder rearward of the midpoint of the strap. This position is somewhat safer than the patrol position in the event of an unintentional discharge of the weapon and is a position which may be preferred by hunters. In the patrol rest position, the upper end of the elongated planar member rotates outward and away from the butt end of the gun stock. The contact of the lower end of the planar member with the base of the butt still provides support against twisting or rotating of the weapon. Both the patrol and patrol rest positions permit the weapon to be carried comfortably and securely by the bearer while freeing both hands.

Figure 4:
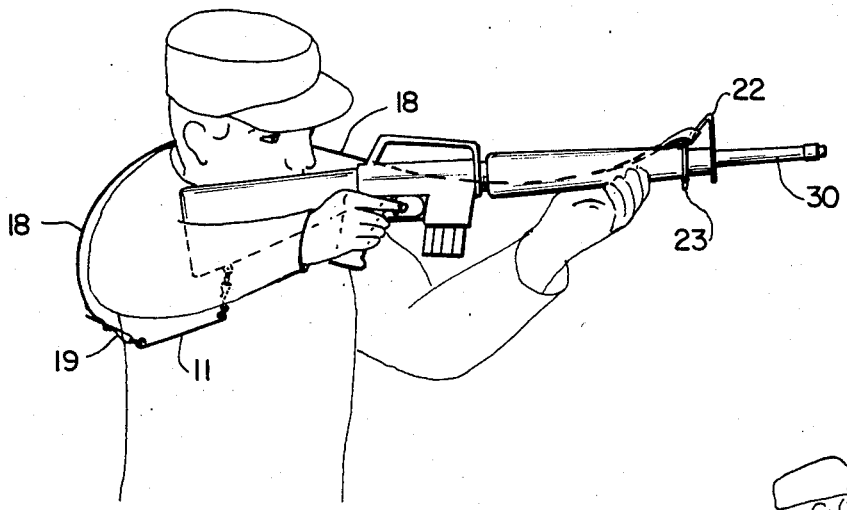
FIG. 4 depicts a man aiming a rifle from the shoulder position and illustrates the position of the sling assembly of this invention when the rifle is raised to the shoulder for firing.

Although the weapon may be readily fired from the patrol position, for more accurate firing of the weapon, it may be lifted to a conventional firing position in which the butt end of the gun stock rests against the shoulder of the bearer, as illustrated in FIG. 4. In such a position, tension is removed from the strap and the rear portion of the flexible strap and the elongated planar member 11 pivots downwardly and away from the butt end of the stock. In this position, the stock is unhindered by the sling and the weapon may be readily aimed without interference from the sling or strap. Alternatively, with the sling adapter of this invention, the sling can be positioned in a tight sling position, as illustrated in FIG. 6, and used for tight sling firing where accuracy is paramount and stability is, therefore, essential. The generally linear nature of the sling adapter provides a relatively clean profile, i.e., it appears as essentially a linear extension of the flexible sling strap and does not interfere with the function of the weapon as more bulky and cumbersome structures may.

Figure 5:
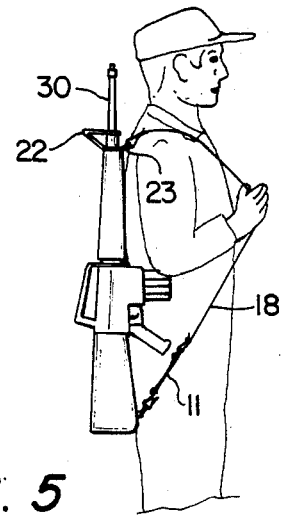
FIG. 5 depicts a man carrying a rifle in a conventional shoulder carry position using the sling assembly of this invention.

The weapon may also be carried in the conventional position shown in FIG. 5, suitable for drills, parades, etcetera. To carry the weapon in this position, if the forward or muzzle end of the strap has been secured to either a fixed sling terminal located at the underside of the weapon or a rotatable sling terminal, no detachment of the forward end of the strap is required. However, if the weapon is equipped with a front sight to which the strap has been secured, it is preferable to detach the strap from the front sight base and reattach it to the front sling terminal 23 on the underside of the barrel. When the weapon is carried in a substantially vertical position with the forward end of the strap positioned at the underside of the muzzle end of the weapon, the elongated planar member 11 rotates or pivots with the rotatable, releasable attaching means around the fixed terminal sling 17.

It is apparent that many different embodiments of this invention may be made without departing from the scope and spirit thereof and, therefore, it is not intended to be limited except as indicated in the appended claims.

INDUSTRIAL APPLICABILITY:

The present invention is useful for carrying firearms having fixed stocks and an elongated barrel such as a rifle or a shotgun, more particularly for carrying modern military rifles such as the M-16. It is particularly useful in applications for carrying the weapon in a comfortable and practical position without the use of the weapon carrier's hands and arms. The present invention provides an assembly which can quickly and easily be removed without losing small screws or pins and, in the case of the M-16 illustrated, requires no modifications nor does it mar or deface the weapon.

I claim:

1. In combination with a firearm having a stock with a butt end and a sling strap or web for carrying said firearm, the improvement comprising a sling adapter having:

an elongated, generally planar member having first and second ends and being commensurate in length with the longitudinal dimension of the butt end of the stock of the firearm;

means at said first end of said elongated planar member rotatably attaching said first end of said member to said sling strap or web;

means at said second end of said elongated planar member releasably and rotatably attaching said second end of said member to the underside of the stock; and wherein said sling adapter is so constructed and arranged with respect to the butt end of said firearm that (1) the firearm can be carried in a substantially horizontal stable position while suspended from a shoulder of the bearer of the firearm in position for firing, (2) when tension is removed from said sling strap web by lifting said firearm to a conventional firing position, said sling planar member pivots downwardly and away from said butt end of the stock and said stock is unhindered by the sling and said firearm may be readily aimed without interference, and (3) the generally planar nature of said adapter allows said sling strap or web to be positioned in a tight sling position for tight sling firing.

2. The combination according to claim 1 wherein said rotatably attaching means comprises a ring rotatably secured within a sleeve located at said first end of said elongated member.

3. The combination according to claim 2 wherein said ring has a generally oblong shape.

4. The combination according to claim 1 wherein said releasably and rotatably attaching means comprises a ring rotatably secured within a sleeve located at said second end of said elongated member, said ring rotatably attached to a clip.

5. The combination according to claim 4 wherein said ring has a generally oblong shape.

6. The combination according to claim 1 wherein said flexible strap is provided with means for adjusting the length of said flexible strap.

7. The combination according to claim 1 wherein said generally planar member is steel.

* * * * *